United States Patent [19]

Kulke

[11] 4,240,385

[45] * Dec. 23, 1980

[54] INJECTION VALVE FOR INTERNAL COMBUSTION ENGINES

[75] Inventor: Günter Kulke, Esslingen, Fed. Rep. of Germany

[73] Assignee: Robert Bosch GmbH, Stuttgart, Fed. Rep. of Germany

[ * ] Notice: The portion of the term of this patent subsequent to Mar. 13, 1996, has been disclaimed.

[21] Appl. No.: 11,824

[22] Filed: Feb. 13, 1979

Related U.S. Application Data

[63] Continuation of Ser. No. 847,299, Oct. 31, 1977, Pat. No. 4,143,625.

[30] Foreign Application Priority Data

Nov. 26, 1976 [DE] Fed. Rep. of Germany ..... 2653674

[51] Int. Cl.[3] ..... F02M 53/04

[52] U.S. Cl. ..... 123/470; 123/468

[58] Field of Search ..... 123/32 R, 32 JV, 32 AB, 123/32 AE, 139 AW; 239/530, 533.3, 533.4, 533.5, 533.6, 533.7, 533.8, 533.9, 533.11, 397.5

[56] References Cited

U.S. PATENT DOCUMENTS

| | | | |
|---|---|---|---|
| 3,776,209 | 12/1973 | Wertheimer et al. | 123/32 R |
| 3,841,277 | 10/1974 | Schafer | 123/32 R |
| 3,857,573 | 12/1974 | Pugh | 123/139 AW |
| 3,941,109 | 3/1976 | Schmid | 123/32 R |
| 4,143,625 | 3/1979 | Kulke | 123/32 R |

FOREIGN PATENT DOCUMENTS

| | | | |
|---|---|---|---|
| 2208646 | 8/1973 | Fed. Rep. of Germany | 123/32 R |
| 2208887 | 9/1973 | Fed. Rep. of Germany | 123/139 AW |
| 2233919 | 1/1974 | Fed. Rep. of Germany | 123/139 AW |

*Primary Examiner*—Leonard E. Smith
*Attorney, Agent, or Firm*—Edwin E. Greigg

[57] ABSTRACT

An injection valve to control the fuel injection into the intake duct of an internal combustion engine. The injection valve, which is preferably mechanically actuated, is placed in a supporting opening in the wall of an intake duct, and is provided with a gasket between the outer wall of the injection valve housing and the outer wall of the support. The injection valve housing is arranged contact-free in the support opening and the thus-produced annular slit is closed by a bellows member. The injection valve housing is associated at its free end with a fuel distributor element. In this manner a greater freedom of movement of the valve housing in the support opening is thereby provided in addition to a substantial increase in thermal insulation, whereby manufacturing tolerances and thermal fluctuations are not significant.

4 Claims, 1 Drawing Figure

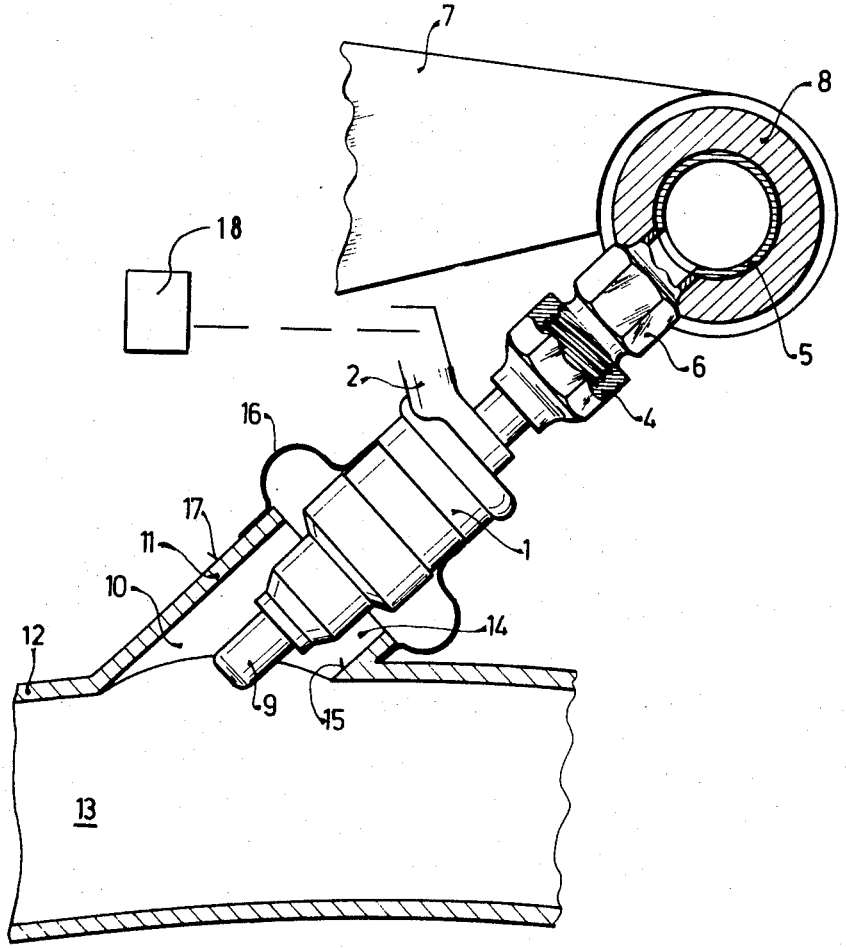
7
8
18
5
6
2
4
16
17
1
11
10
14
12
9
15
13

INJECTION VALVE FOR INTERNAL COMBUSTION ENGINES

This is a continuation of application Ser. No. 847,299, filed Oct. 31, 1977, now U.S. Pat. No. 4,143,625.

BACKGROUND OF THE INVENTION

The invention relates to injection valves and more particularly to mechanically controlled fuel injection valves that are disposed in the intake duct of an internal combustion engine. It is commonplace for such valves to be placed in supports in the wall of an intake duct and provided with a seal between the outer wall of the injection valve housing and the inner wall of the support. This type of injection valve is known (DT-OS No. 2,149,817). In this known type of valve the valve housing is placed in a rubber ring, which in turn is placed in a bushing made of thermal insulating material and thus is arranged to have only a small contact surface with the adjacent housing. Nevertheless, such a small contact surface still presents a bridge for a thermal transfer.

The fuel injection valves built into the intake duct or the engine block of an internal combustion engine are severely heated, especially after the engine has been turned off, by either a direct or indirect thermal transfer of heat spreading from the hot engine and the exhaust ducts.

OBJECT AND SUMMARY OF THE INVENTION

Accordingly, the principal object of the present invention is to provide an extremely efficient thermal insulation between the injection valve housing and the wall in the intake duct within which the valve is supported.

It is a further object of the invention to provide an arrangement wherein the valve housing has a greater freedom of movement within the aperture provided for support of the valve. In this manner, tolerances necessary for manufacture and varying thermal fluctuations are no longer important.

The invention will be better understood as well as further objects and advantages thereof become more apparent from the ensuing detailed description taken in conjuction with the drawing.

BRIEF DESCRIPTION OF THE DRAWING

An exemplary embodiment of the invention is illustrated, partially in section and partially in elevation, in the single FIGURE of the drawing.

DESCRIPTION OF THE PREFERRED EMBODIMENT

Turning now to the drawing, there is shown an injection valve provided with a valve housing 1 which includes on one side thereof a connection 2 for receiving the extension of a mechanical actuator 18, shown only schematically, which can be, for example, a lever which is cam actuated, with the cam operation being dependent on engine speed.

The valve housing 1 is provided with a cap screw 4 with which it is threadedly secured to an attachment 6 which is arranged to extend through an opening in the wall of a fuel distributor 5 which is not shown in more detail. The fuel distributor 5 is connected with an internal combustion engine (not shown) by a mounting means 7. The fuel distributor 5 is surrounded by a noise damping layer 8, through which the screw attachment 6 is arranged to project.

An injection end 9 of the valve housing 1 is positioned in an opening 10 of a support 11, which is provided in the wall 12 of an intake duct 13. Accordingly, in this manner the injection valve housing 1 is arranged to be supported centrally of the aperture 10 without any contact with the surrounding wall 11 while at the same time the terminal end 9 is supported in proper position in the intake duct 13. The annular space 14 that is provided between the injection valve housing 1 and the interior wall 15 of the surrounding wall 11 is enclosed by a bellows type member 16 one end of which is attached to the perimetral wall of the injection housing 1 and the other end thereof is arranged to be supported on the outer wall or collar 17 of the support 11. The bellows member 16 prevents air from entering the intake duct 13 without exerting any kind of oblique forces on the injection valve.

It should also be noted that the intake duct 13 can also be embodied in the cylinder head of an internal combustion engine and that the injection valve can be activated electrically by, for example, an electromagnet instead of mechanically. Further, it is to be understood that it is conceivable to provide an injection jet in place of an injection valve.

By means of the free hanging arrangement of the injection valve in the intake duct an excellent thermal insulation is achieved. The free movement removes the detrimental effect of manufacturing tolerances and varying thermal fluctuations.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An injection valve for mechanically controlled feed of fuel into an intake duct of an internal combustion engine, said valve being supported by sealing means in means defining an aperture in said intake duct, the further improvement wherein:

said injection valve which includes an exterior wall is supported freely within said means defining said aperture by a bellows means.

2. An injection valve as described in claim 1, wherein said means defining said aperture includes a collar means and said bellows means includes oppositely extending portions that are secured to said collar and said exterior wall of said valve.

3. An injection valve as described in claim 1, wherein said injection valve includes a housing affixed by means of a cap screw to a fuel distributor which is associated with said engine by a mounting means.

4. An injection valve as described in claim 3, wherein said fuel distributor includes an attaching means for said cap screw which extends through a noise damping layer.

* * * * *